US008164452B2

(12) United States Patent
Moses et al.

(10) Patent No.: US 8,164,452 B2
(45) Date of Patent: Apr. 24, 2012

(54) POST OFFICE BOX ELECTRONIC NOTIFICATION SYSTEM

(76) Inventors: Robert Moses, Miami, FL (US); Richard Moses, Miami, FL (US)

( * ) Notice: Subject to any disclaimer, the term of this patent is extended or adjusted under 35 U.S.C. 154(b) by 284 days.

(21) Appl. No.: 12/423,399

(22) Filed: Apr. 14, 2009

(65) Prior Publication Data

US 2010/0033328 A1 Feb. 11, 2010

Related U.S. Application Data

(60) Provisional application No. 61/086,368, filed on Aug. 5, 2008, provisional application No. 61/095,456, filed on Sep. 9, 2008.

(51) Int. Cl.
*G08B 13/14* (2006.01)

(52) U.S. Cl. ..... 340/569; 340/570; 340/531; 340/540; 340/525; 340/568.1; 340/571; 348/152; 348/E5.042

(58) Field of Classification Search ..... 340/569, 340/570, 531, 540, 525, 568.1, 4.6, 571; 348/152, E5.042
See application file for complete search history.

(56) References Cited

U.S. PATENT DOCUMENTS 3,611,333 A 10/1971 Conigliaro
4,204,632 A 5/1980 Cook
4,314,102 A 2/1982 Lowe et al.
5,036,310 A 7/1991 Russell
5,239,305 A 8/1993 Murphy et al.
5,440,294 A 8/1995 Mercier et al.
5,818,336 A 10/1998 Varga et al.
6,028,517 A 2/2000 Sansone et al.
6,114,959 A 9/2000 Bennett
6,307,472 B1 10/2001 Robertson
6,323,782 B1 11/2001 Stephens et al.
6,448,898 B1 9/2002 Kasik
6,483,433 B2 11/2002 Moskowitz et al.
6,816,074 B2 11/2004 Wong
6,831,558 B1 * 12/2004 Andrew ..... 340/539.2
6,879,255 B1 4/2005 Jezierski
6,961,711 B1 11/2005 Chee
6,963,357 B2 11/2005 Semones
6,965,310 B1 11/2005 Hoben et al.
6,980,110 B1 12/2005 Hoben et al.
6,987,452 B2 1/2006 Yang
6,995,671 B2 2/2006 Dutta et al.
7,061,377 B1 * 6/2006 Kraus ..... 340/545.6
7,076,466 B2 7/2006 Sansone
7,080,038 B2 7/2006 Sansone
7,085,811 B2 8/2006 Sansone et al.
7,089,210 B2 8/2006 Sansone
7,183,919 B2 2/2007 Wang
7,187,285 B2 * 3/2007 Staples ..... 340/569
7,252,228 B2 8/2007 Avant et al.
7,337,944 B2 3/2008 Devar
(Continued)

*Primary Examiner* — Tai T Nguyen
(74) *Attorney, Agent, or Firm* — Lowe Hauptman Ham & Berner, LLP

(57) ABSTRACT

A system for and method of generating a notification regarding post office box contents. The system comprises at least one indicator transmitter arranged to generate and transmit a notification signal regarding contents of the post office box responsive to an operator actuation, and at least one receiver/network interface communicatively coupled with the at least one indicator transmitter and arranged to transmit a first signal responsive to receipt of the notification signal from the at least one indicator transmitter. The method comprises generating a notification signal responsive to an operator actuation responsive to a change of the contents of a post office box, and transmitting the generated notification signal to a client device.

16 Claims, 9 Drawing Sheets

U.S. PATENT DOCUMENTS 7,346,591 B2 3/2008 Sansone
7,386,457 B2 6/2008 Sansone
7,386,458 B2 6/2008 Sansone
7,389,238 B2 6/2008 Sansone et al.
7,398,915 B1 * 7/2008 Pineda-Sanchez et al. ..... 232/36
7,525,429 B2 4/2009 Carrigan
7,786,862 B1 * 8/2010 Campbell ..... 340/569
2002/0024438 A1 2/2002 Robertson
2002/0103868 A1 8/2002 Khan
2004/0060975 A1 4/2004 Dalgaard et al.
2006/0044139 A1 3/2006 St. Clair et al.

* cited by examiner

POST OFFICE BOX ELECTRONIC NOTIFICATION SYSTEM

RELATED APPLICATIONS

The present application is based on, and claims priority from, Provisional Application No. 61/086,368, filed Aug. 5, 2008, and Provisional Application No. 61/095,456, filed Sep. 9, 2009, the disclosures of which are hereby incorporated by reference herein in their entirety.

BACKGROUND

FIG. 1 depicts a high-level view of a user 100, i.e., a customer, entering a post office box business 102 having a post office box 104 therein, e.g., a post office or a retail establishment which provides post office box services. A post office box is often a numbered box in a post office assigned to an entity, e.g., a person or organization, within which mail for the entity is retained until collected.

In accordance with a nominal scenario, user 100 travels either from the user's home 106, from the user's office 108, or from another location to business 102 in order to check the contents of post office box 104 and determine whether a new item has arrived in the box. Travel between the user's home 106 or office 108 is time-consuming, often requires the use of a vehicle and attendant expenses, and user 100 has no indication as to whether mail is in post office box 104. Thus, many unnecessary trips may be undertaken by user 100 wherein the user arrives at business 102 only to find out no mail is present in box 104.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
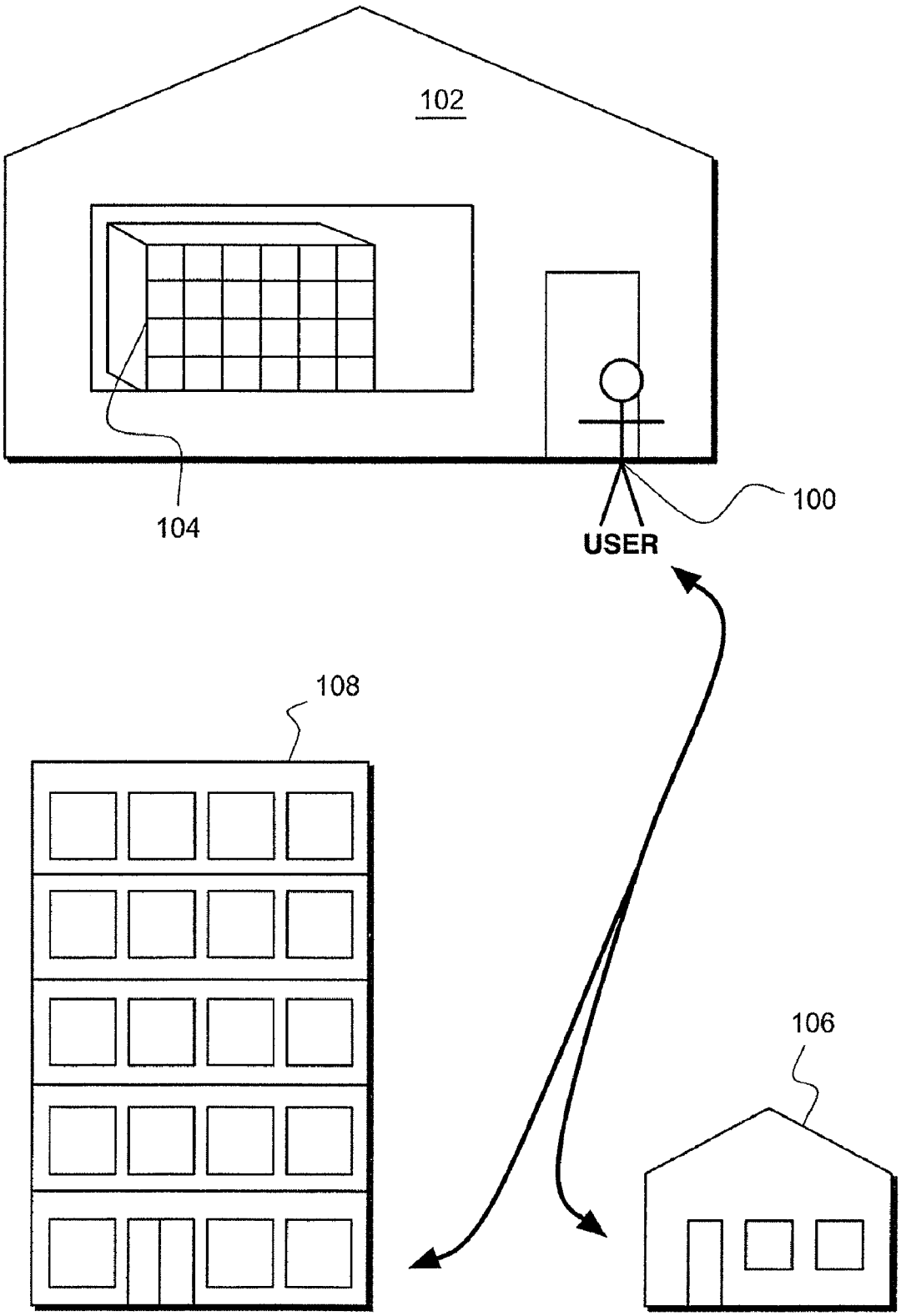
FIG. 1 (Prior Art)
FIG. 1 is a high-level block diagram of a user checking a post office box.
Figure 2:
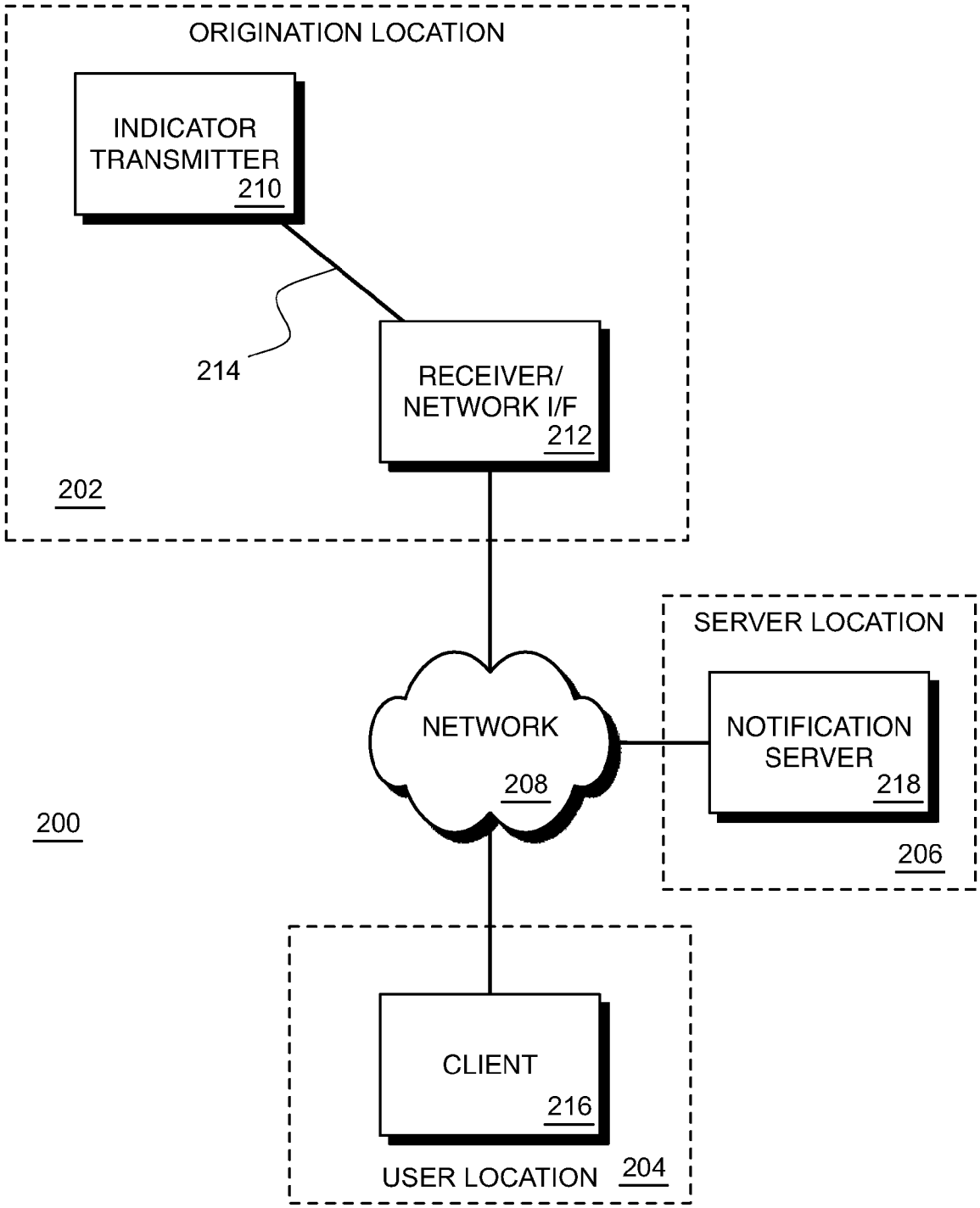
FIG. 2 is a functional block diagram of a notification system according to an embodiment.

FIG. 2 depicts a high-level functional block diagram of a notification system 200 according to an embodiment of the present invention. Notification system 200 provides a mechanism for generating and transmitting a notification signal from, e.g., post office box 104, to the customer 100. At a high-level, notification system 200 comprises a notification origination location 202, e.g. post-office box 104 or business location 102, communicatively coupled with a central server location 206 and a client device 216 at a user location 204 via a network 208. Network 208 may comprise one or more wired and/or wireless connections for interconnecting origination location 202, server location 206, and user location 204. Network 208 may comprise a local area network, a wide area network, or other network. For example, network 208 may comprise a packet-switched network known as the Internet. In at least some embodiments, network 208 may comprise a cable modem, digital subscriber line (DSL), integrated services data network (ISDN), T-1, Data T3 DS3, dial-up modem or other wired connection or a cellular packet data network, e.g., 2.5G, 3G, 3.5G, 4G in global system for mobile (GSM) or code division multiple access (CDMA), integrated digital enhanced network (IDEN), private radio frequencies, worldwide interoperability for microwave access (WIMAX), long term evolution (LTE), satellite (uplink, downlink, or a combination thereof) or other wireless connection.

Notification origination location 202 is a location, e.g., a building or other structure, which includes one or more post office boxes, e.g., post office box 104. Notification origination location 202 comprises at least one indicator transmitter 210 communicatively coupled with a receiver/network interface (I/F) 212. Indicator transmitter 210 is coupled with receiver/network I/F 212 via a first connection 214 which may be a wired and/or a wireless connection. In at least some embodiments, first connection 214 is a serial connection and/or a parallel connection.

Indicator transmitter 210 comprises a signal generator arranged to generate a notification signal transmitted to receiver/network I/F 212 responsive to operation of a connected switch. In at least some embodiments, the connected switch may be a momentary switch, a toggle switch or another switch able to cause the signal generator to generate a notification signal which indicates the presence or absence of an item such as mail in a post office box. In at least some embodiments, indicator transmitter 210 is positioned adjacent post office box 104. In at least some embodiments, indicator transmitter 210 is positioned within post office box 104 at notification origination location 202. In at least some embodiments, indicator transmitter 210 is positioned external of post office box 104. In at least some embodiments, indicator transmitter 210 installation requires no addition or removal to/from a portion of post office box 104.

In at least some embodiments, the notification signal comprises information which identifies the corresponding post office box and whether the post office box contains mail. In at least some embodiments, the notification signal comprises a signal which solely, uniquely identifies a particular post office box. In at least some embodiments, the notification signal comprises an encrypted signal.

In at least some embodiments, an operator at origination location 202 manipulates indicator transmitter 210, e.g., via depressing, toggling, or otherwise actuating a switch or other mechanism of the indicator transmitter, to cause generation and transmission of the notification signal. In at least some embodiments, operator manipulation of indicator transmitter 210 is performed to indicate the presence and/or absence of items from the post office box. In at least some embodiments, the operator is a user or worker at the post office box location, i.e., notification origination location 202.

In at least some embodiments, indicator transmitter 210 may be triggered to generate the signal for transmission to receiver/network I/F 212 responsive to detection of mail in the post office box. For example, in some embodiments a motion detection system, a weight change system, or other proximity or other detection system may be used to cause the trigger of indicator transmitter 210. In at least some embodiments, manual triggering of indicator transmitter 210 by an operator occurs exclusive of an automatic triggering.

Receiver/network I/F 212 comprises at least one interface arranged to receive the notification signal from indicator transmitter 210 and at least one interface arranged to retransmit the notification signal to a notification server 218 at server location 206 via network 208. In at least some embodiments, receiver/network I/F 212 comprises a single interface arranged to perform both functions. In at least some embodiments, receiver/network I/F 212 comprises a plurality of interfaces arranged to receive the notification signal. In at least some embodiments, receiver/network I/F 212 comprises a number of indicator transmitter interfaces corresponding to the number of indicator transmitters with which receiver/network I/F 212 may be communicating. In at least some embodiments, receiver/network I/F 212 comprises a number of indicator transmitter interfaces corresponding to the number of indicator transmitters at origination location 202.

In at least some embodiments, receiver/network I/F 212 buffers one or more received notification signals in order to perform a bursty transmission of notification signals to notification server 218.

In at least some embodiments, indicator transmitter 210 is arranged to receive an image of the mail inserted into post office box 104 and include the image into the notification signal. In at least some embodiments, the image is arranged to comprise at least the return address portion of the mail. In at least some other embodiments, the image comprises the entirety of the face or addressed portion of the mail inserted in post office box 104. In at least some embodiments, the capture of the image is performed manually by a worker at origination location 202. For example, the worker may scan at least a portion of an item, e.g., using an optical scanner associated with indicator transmitter 210, to generate an image to be transmitted with or subsequent to transmission of the notification signal. In at least some embodiments, the scanner may be located at a different location than indicator transmitter 210. In at least some embodiments, capture of the image is performed automatically upon insertion of the mail in post office box 104.

In at least some embodiments, a worker at origination location 202 manually activates the indicator transmitter 210 switch. In other embodiments, the switch is automatically activated by insertion of mail in post office box 104.

In at least some embodiments, responsive to transmission of the notification signal, receiver/network I/F 212 receives an acknowledgement signal indicative of receipt of the notification signal.

Figure 3:
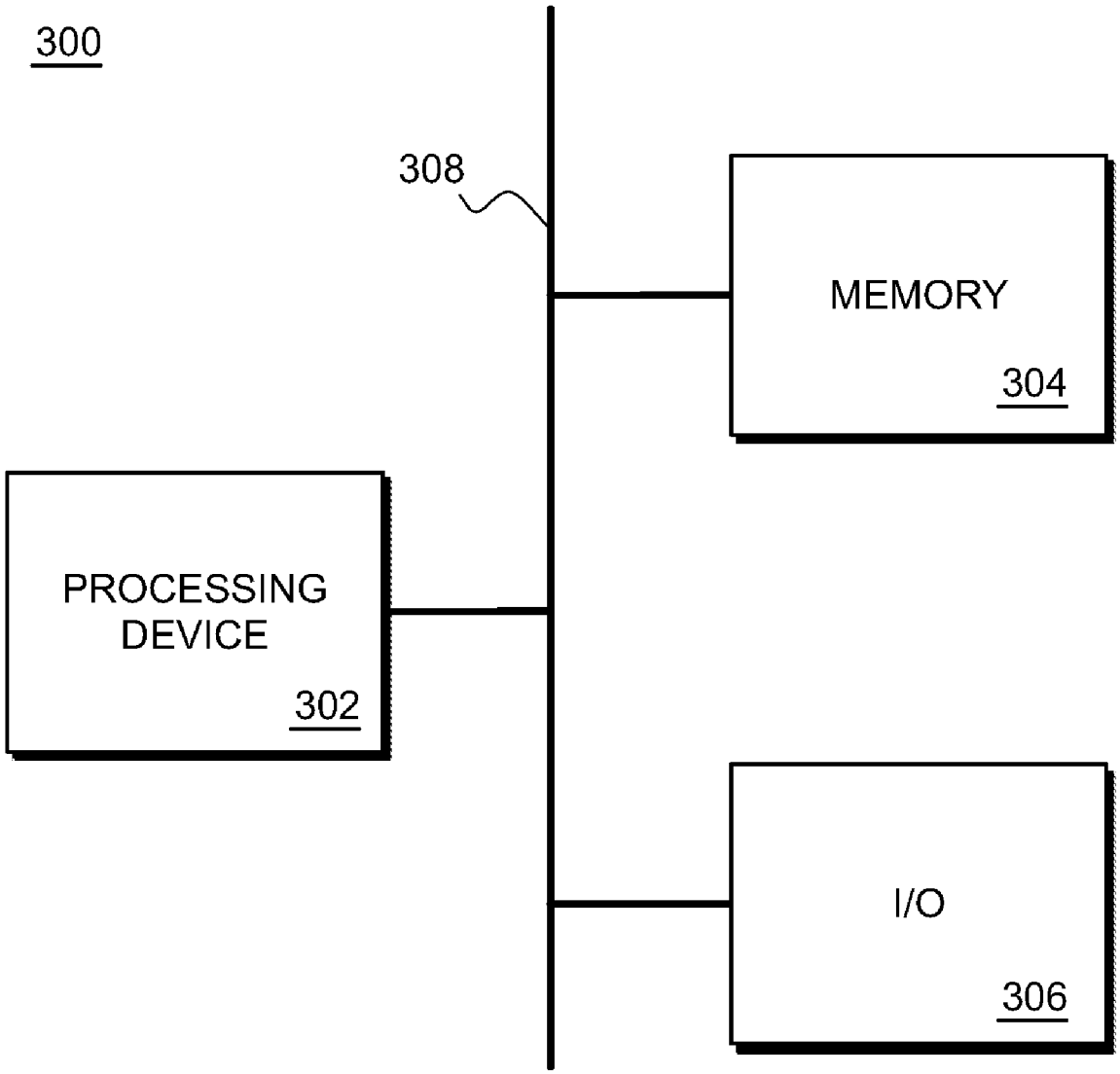
FIG. 3 is a high-level functional block diagram of a computer system according to an embodiment.

Server location 206 comprises notification server 218 which may be a computer system, e.g., as depicted in FIG. 3. In at least some embodiments, origination location 202 comprises a computer system as depicted in FIG. 3, e.g., a computer system may include indicator transmitter 210 therein or as a portion thereof.

FIG. 3 depicts a high-level functional block diagram of an embodiment 300 of notification server 218 as a processing device for executing a set of instructions. Embodiment 300 comprises a processing device 302, a memory 304, and an input/output (I/O) device 306 each communicatively coupled with a bus 308. Memory 304 (also referred to as a computer-readable medium) is coupled to bus 308 for storing data and information, e.g., notification signal(s), user/customer preferences, and instructions to be executed by processing device 302. Memory 304 also may be used for storing temporary variables or other intermediate information during execution of instructions to be executed by processing device 302. Memory 304 may also comprise a read only memory (ROM) or other static storage device coupled to bus 308 for storing static information and instructions for processing device 302. Memory may comprise static and/or dynamic devices for storage, e.g., optical, magnetic, and/or electronic media and/or a combination thereof.

I/O device 306 may comprise an input device, an output device, and/or a combined input/output device for enabling interaction with notification server 218. For example, I/O device 306 may comprise a user input device such as a keyboard, keypad, mouse, trackball, microphone, scanner, or other input mechanism, and/or an output device such as a display, speakers, or other output mechanism.

Returning to FIG. 2, notification server 218 is communicatively coupled with receiver/network I/F 212 and client device 216 via network 208. Notification server 218 comprises one or more interfaces for communicating via network 208. Notification server 218 is arranged to receive a notification signal transmitted by receiver/network I/F 212, determine to which customer 100 the notification signal is destined, and retransmit the notification signal to the customer by way of client device 216. In at least some embodiments, notification server 218 determines to which customer 100 the signal is destined by inspecting the contents of the notification signal, e.g., envelope and/or header information of the signal. In at least some embodiments, notification server 218 relies on solely the contents of the signal to determine the destination. In at least some other embodiments, notification server 218 relies on a lookup table or similar mechanism to compare information in the received notification signal to known destination information. For example, in at least some embodiments, notification server 218 looks up the email address, phone number, and/or messaging address of the customer 100 to whom the notification signal is destined. Based on the determination, notification server 218 retransmits the notification signal to client 216. In at least some embodiments, notification server 218 may cause the generation and delivery of an audio signal destined for a telephonic device of a customer for delivery of the notification signal. In at least some embodiments, the audio signal may be generated at notification server 218, receiver/network I/F 212, and/or indicator transmitter 210. In at least some embodiments, a customer may be able to customize the particular audio signal delivered. In at least some embodiments, a customer may be able to receive more than one form of notification signal from notification server 218 based on predetermined user/customer preferences. In at least some embodiments, one or more user/customer preferences may specify which form(s) of notification is(are) to be transmitted to client device 216, and/or how often the notification is to be transmitted. In at least some embodiments, a customer at a client device 216 may poll or request information regarding a particular post office box status from notification server 218.

In at least some embodiments, server location 206 may be the same as origination location 202. In at least some other embodiments, server location 206 may be the same as user location 204. In at least some embodiments, receiver/network I/F 212 may be located at server location 206 either separate from or integral with notification server 218. In at least some embodiments, an integral combination of receiver/network I/F 212 and notification server 218 may be arranged in order to reduce component cost. In at least some embodiments, receiver/network I/F 212 may be located at a location separate from either origination location 202, server location 206, and/or user location 204.

In at least some embodiments, server location 206 is arranged to receive notification signals from more than one receiver/network interfaces. In at least some embodiments, server location 206 is arranged to receive notification signals from more than one receiver/network interfaces at one or more origination locations 202.

In at least some embodiments, an operator may use a user input device, such as a computer keyboard, to directly input (key) into notification server 218 the command(s) to direct the server to send a notification signal to the client device alerting a receiving customer of the presence of mail in the post office box. In at least some embodiments, the operator may use the keyboard to directly key a custom message into notification server 218 via network 208 in order to direct the server to send the notification signal to client device 216. In at least some embodiments, the operator may manipulate a mouse or other input mechanism to input and/or select from one or more preset messages for transmission.

Client device 216, e.g., a computer system such as a desktop, laptop, and/or handheld device, a personal digital assistant (PDA), a phone such as a wired and/or wireless phone, a pager, or another device able to receive messages, is located at user location 204. Depending on a time of day, user location 204 may be the user's home, office, or another location where the customer is located. In at least some embodiments, customer 100 may transport client device 216 on or near the customer's body as in a cellular phone, PDA, or laptop. In at least some embodiments, customer 100 may make use of a client device available at the customer's current location such as a computer system or telephone at an office, at an Internet cafe, in a shopping mall, at a house, etc.

In at least some embodiments, client device 216 may comprise a system similar to computer system 300 (FIG. 3).

In at least some embodiments, client device 216 may periodically check with notification server 218 to determine if a notification signal has been received. In at least some embodiments, client device 216 may check based on a preset schedule. In at least some embodiments, client device 216 may check responsive to manipulation by customer 100.

In operation, workers at notification origination location 202 receive, sort, and allocate mail to appropriate post office boxes based on the addressed package. Before, during, and/or after placing mail in post office box 104, the worker causes activation of the switch of indicator transmitter 210. Activation of indicator transmitter 210 switch causes the generation and transmission of the notification signal to receiver/network I/F 212.

Receipt of the notification signal from indicator transmitter 210 causes receiver/network I/F 212 to retransmit the notification signal to notification server 218 via network 208, e.g., the Internet. Receipt of the notification signal from receiver/network I/F 212 causes notification server 218 to retransmit the notification signal to client device 216 based on a determination of the customer to whom the notification signal is destined. Responsive to receipt of the notification signal by client device 216 causes the client device 216 to display or otherwise indicate to the customer the status of post office box 104. In at least some embodiments, client device 216 stores the received notification signal for later display and/or notification to customer 100.

In at least some embodiments, notification server 218 stores the notification signal at the server without retransmitting the signal to client device 216. In accordance with this embodiment, customer 100 manipulates client device 216 to cause the client device to request the notification signal from notification server 218. For example, customer 100 uses client device 216 to access a web site provided by notification server 218 and check the status of post office box 104 based on the stored notification signal at the notification server.

Figure 4:
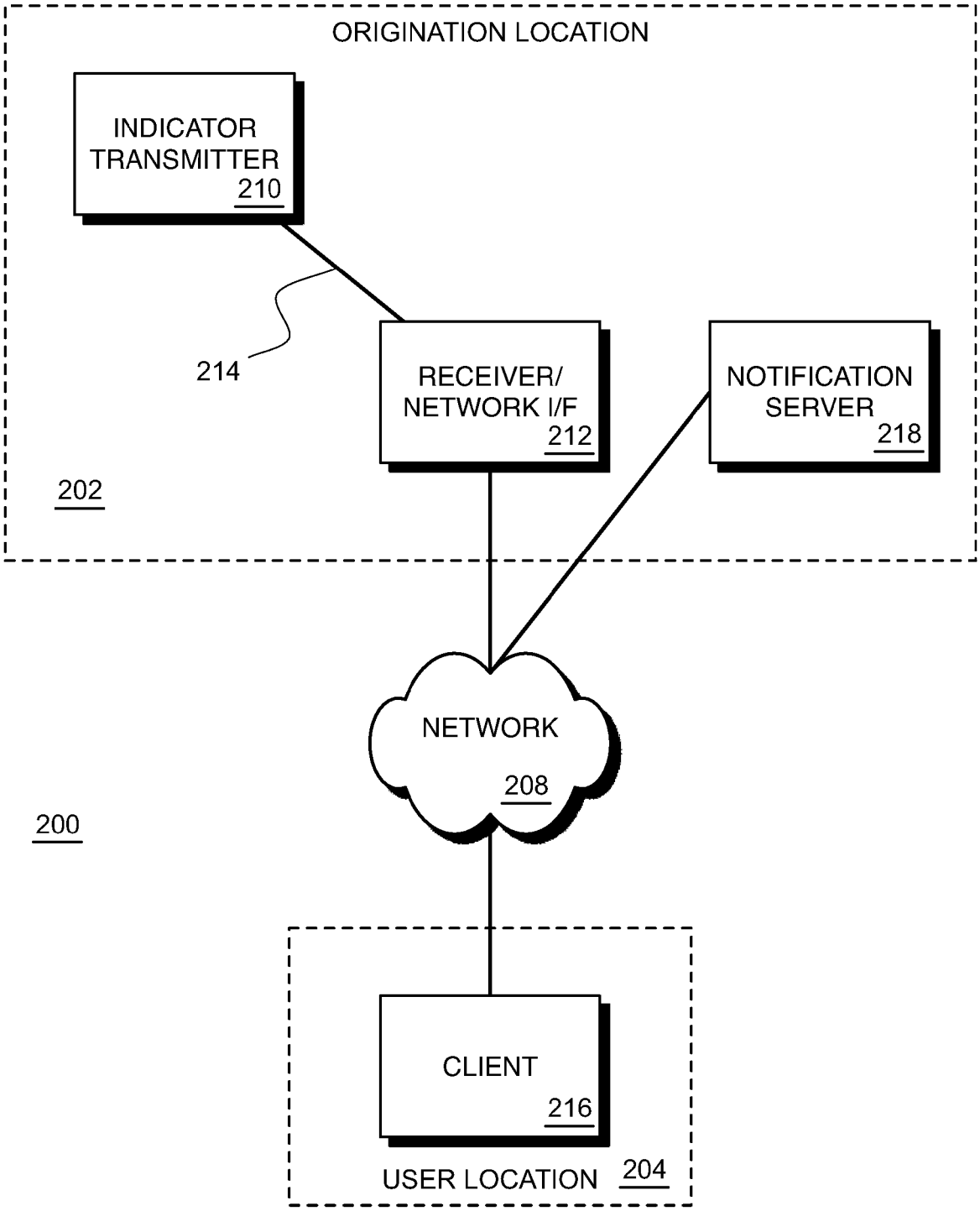
FIG. 4 is a functional block diagram of a notification system according to another embodiment.
Figure 5:
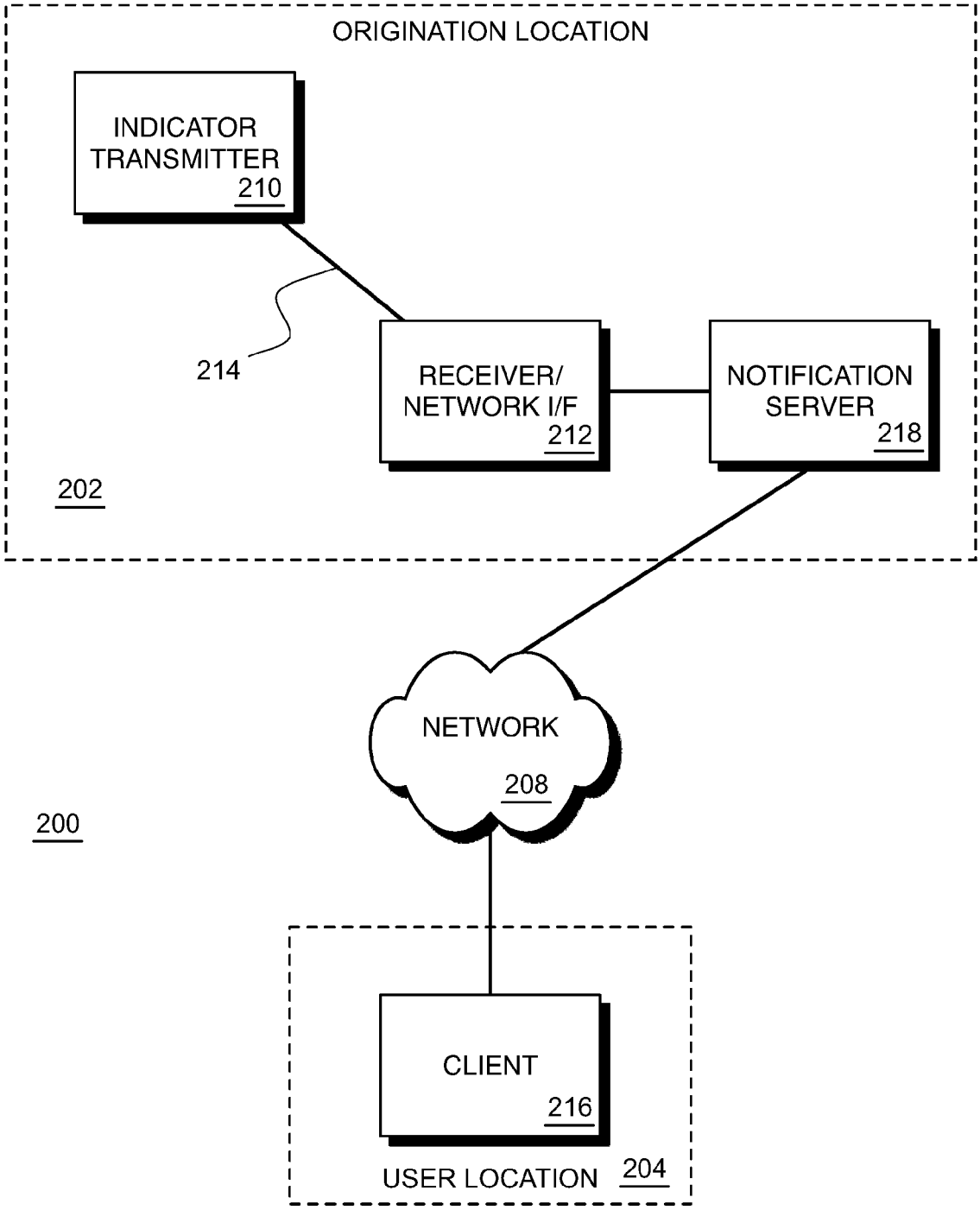
FIG. 5 is a functional block diagram of a notification system according to another embodiment.
Figure 6:
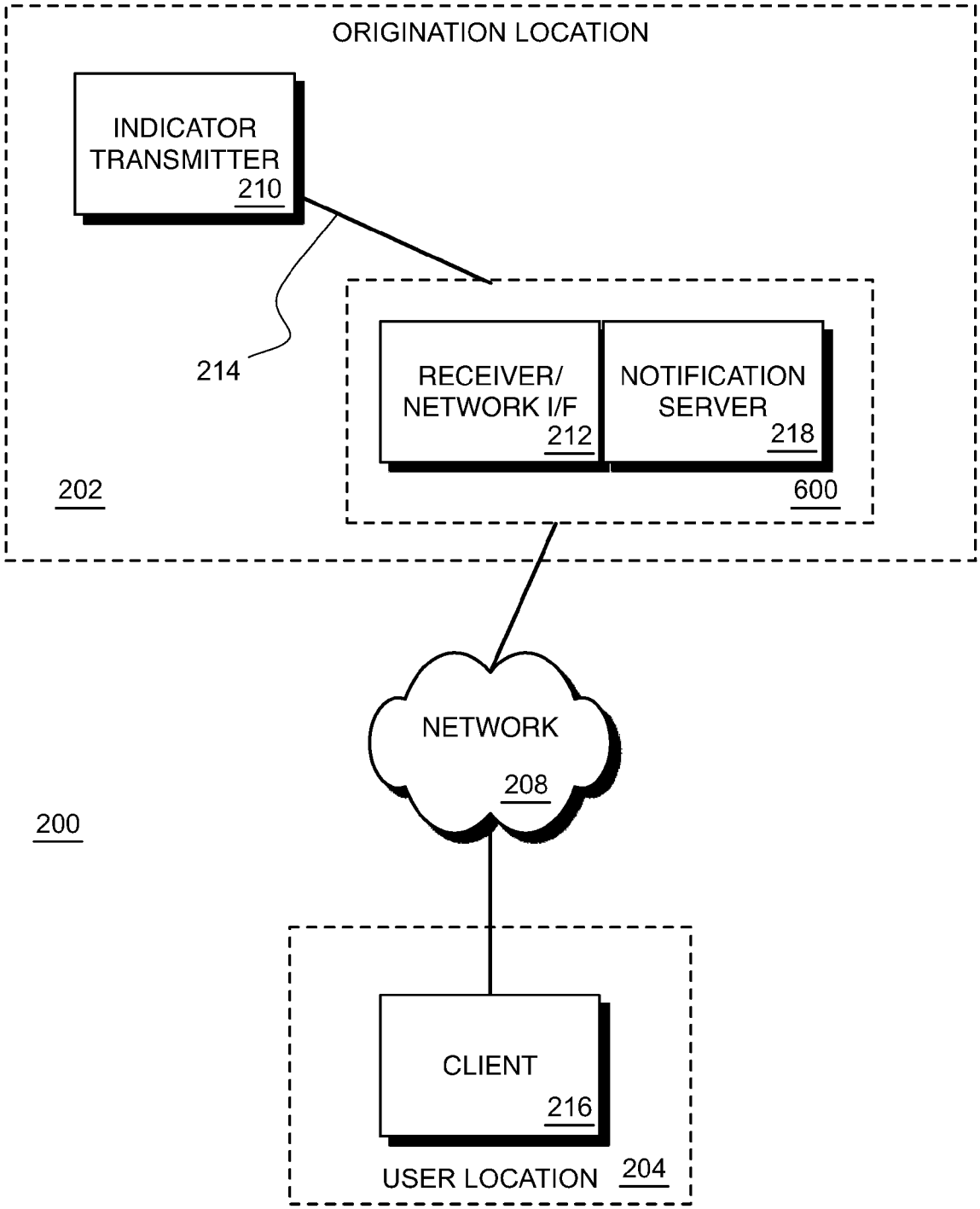
FIG. 6 is a functional block diagram of a notification system according to another embodiment.

FIG. 4 depicts an embodiment in which receiver/network I/F 212 and notification server 218 are co-located at origination location 202. FIG. 5 depicts an embodiment in which receiver/network I/F 212 and notification server 218 are co-located at origination location 202 and in which the receiver/network I/F is directly connected with the notification server 218. FIG. 6 depicts an embodiment in which receiver/network I/F 212 and notification server 218 are integrated as part of a computer system 600 at origination location 202.

Figure 7:
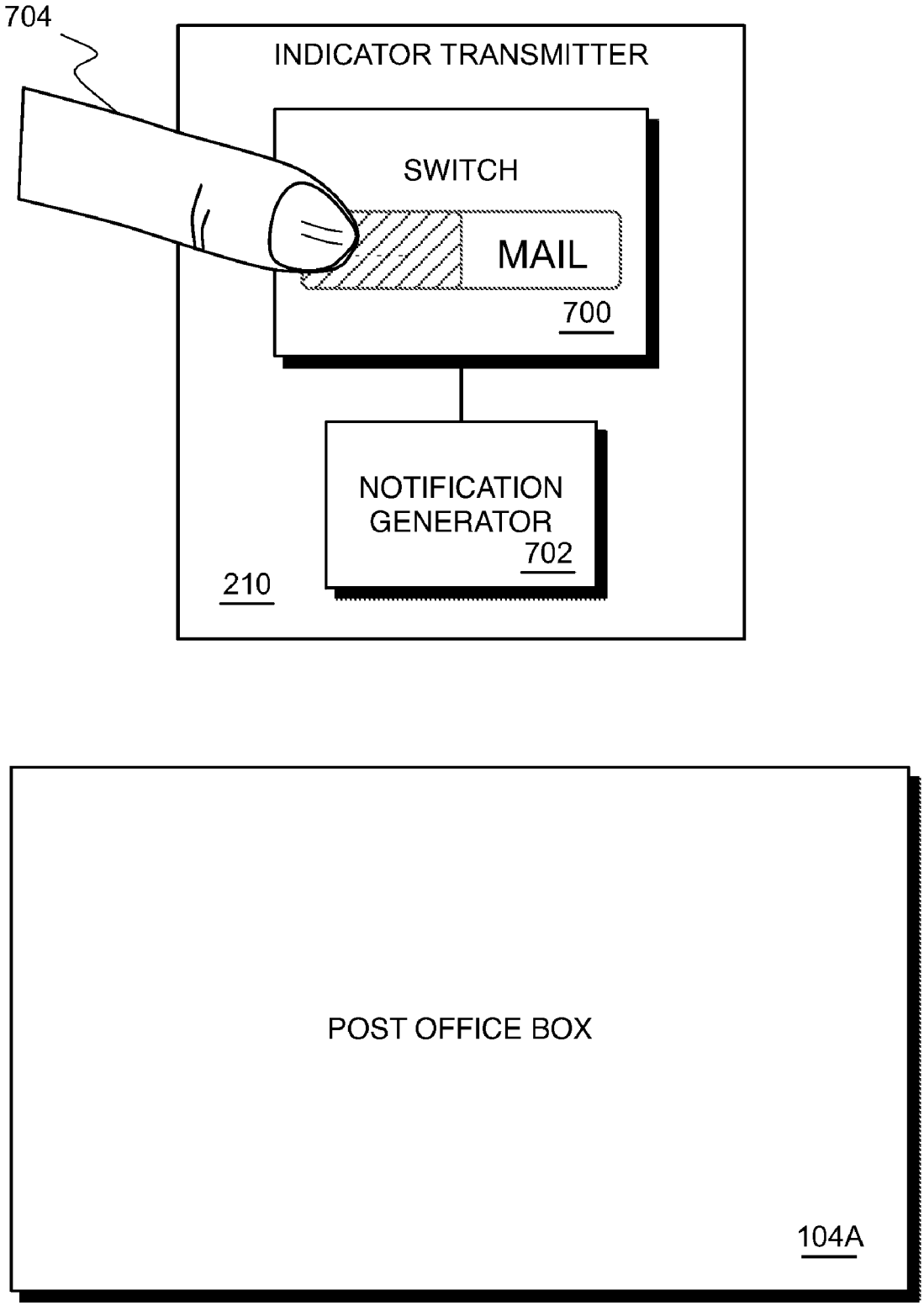
FIG. 7 is a detailed functional diagram of a user actuation of a notification system according to an embodiment.

FIG. 7 depicts a detailed view of at least a portion of indicator transmitter 210 according to an embodiment positioned external of an individual post office box 104A. In accordance with at least the depicted embodiment, indicator transmitter 210 comprises a switch 700 communicatively coupled with a notification generator 702. Switch 700 is an operator-manipulable switch (indicating the presence of items in post office box 104A as depicted) able to be toggled by a user at origination location 202. As stated previously, in some embodiment the user may be an operator or worker at the post office box location.

Responsive to actuation of switch 700 by, e.g., a user finger 704, a signal is transmitted to notification generator 702 arranged to generate and transmit the notification signal from indicator transmitter 210 to receiver/network I/F 212. In at least some embodiments, different types, numbers, and/or configurations of switch 700 are usable in conjunction with embodiments according to the present invention. In at least some embodiments, the operator uses a computer keyboard to input commands to the notification server to indicate the presence of mail in post office box 104A. In at least some other embodiments, the operator and/or user may manipulate an input device other than a keyboard to input commands to either notification server 218 or indicator transmitter 210.

Figure 8:
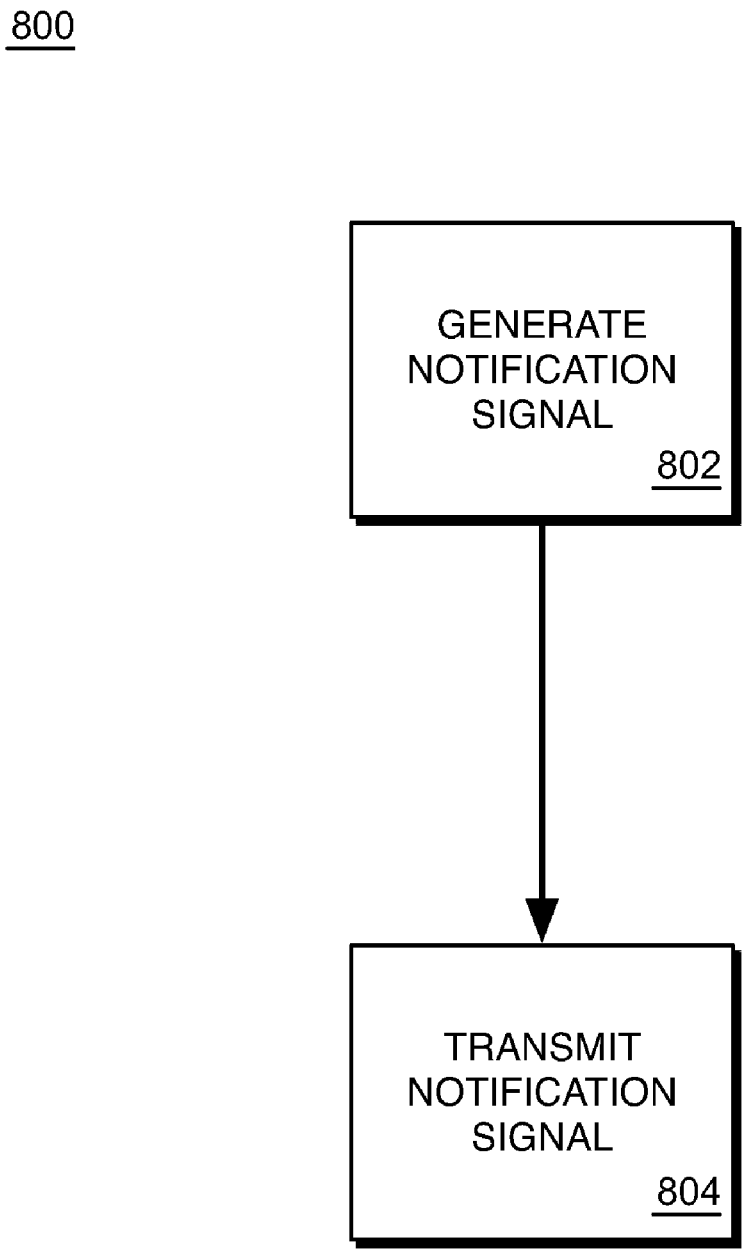
FIG. 8 is a high-level functional block diagram of operation of a notification method according to an embodiment.

FIG. 8 depicts a high-level functional block diagram of operation of a notification method 800 according to an embodiment. The process flow depicted in FIG. 8 represents execution of one or more instructions by one or more processing devices, e.g., processing device 302 (FIG. 3). In at least some embodiments, one or more of the functionalities represented in FIG. 8 may be embodied in a hardware device such as an application specific integrated circuit (ASIC). In at least some embodiments, the set of instructions is stored in memory, e.g., memory 304, of one or more computer systems.

The process flow begins at generate notification signal 802 wherein execution of instructions causes the processing device to generate a notification signal indicative of the presence or absence of an item in a particular post office box. The flow then proceeds to transmit notification signal 804 wherein execution of instructions causes the processing device to cause transmission of a notification signal to a user.

Figure 9:
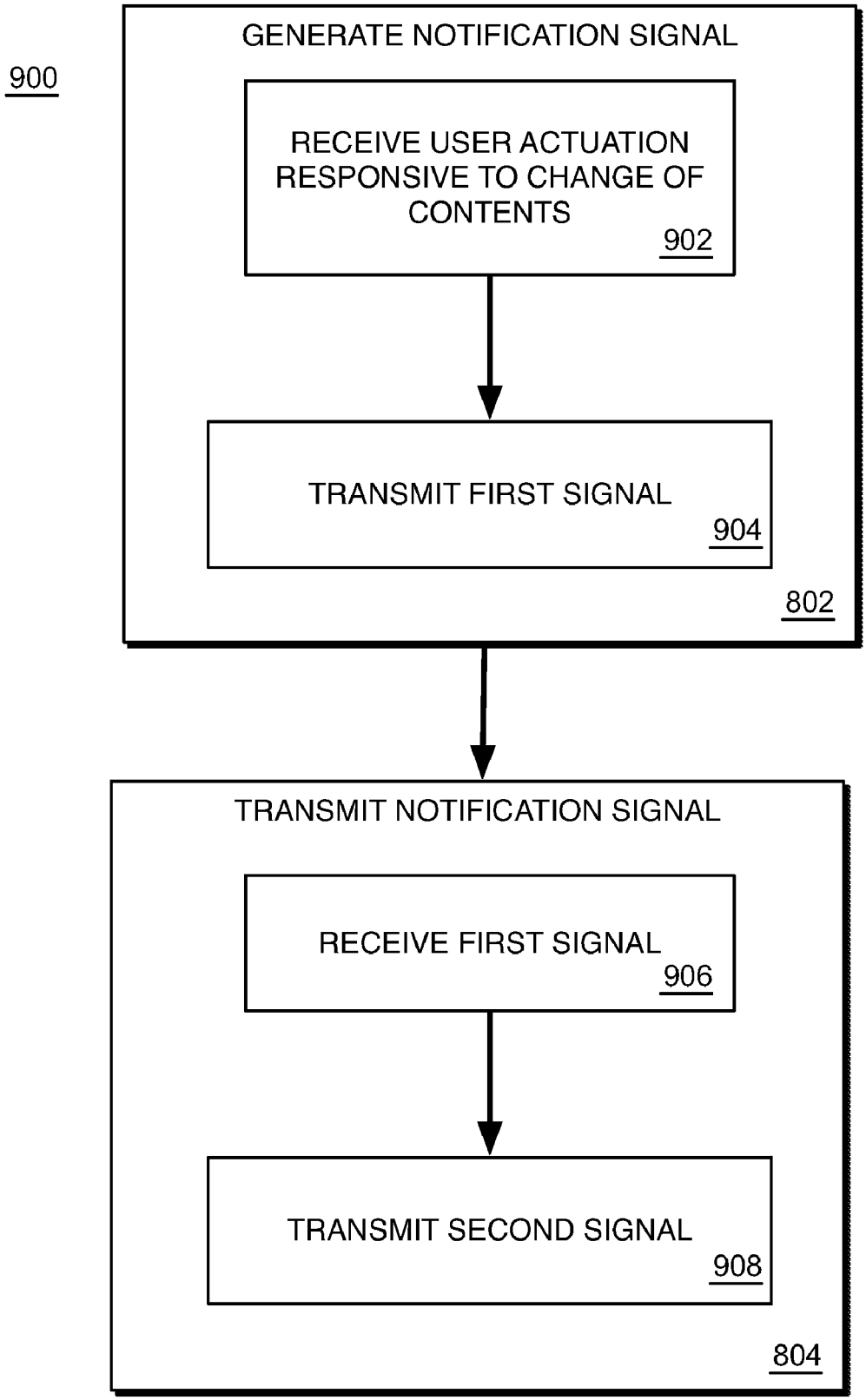
FIG. 9 is a detailed view of an embodiment of the FIG. 8 notification method.

FIG. 9 depicts a detailed view of an embodiment 900 of the FIG. 8 notification method 800. The process flow begins at receive operator actuation functionality 902 wherein operator actuation responsive to a change of contents of a post office box is received. The flow proceeds to transmit first signal 904 wherein execution of a set of instructions causes the processing device to cause the transmission of a first signal.

The flow then proceeds to receive first signal 906 wherein execution of a set of instructions by the processing device causes the processing device to receive the first signal. In at least some embodiments, a different processing device may execute the instructions of receive first signal functionality 906. The flow then proceeds to transmit second signal 908. During execution of the set of instructions comprising transmit second signal 908, the processing device causes the transmission of a second signal to the user.

What is claimed is:

1. A system for generating notifications regarding post office box contents, comprising:

at least one indicator transmitter arranged to generate and transmit a notification signal regarding contents of the post office box responsive to actuation by an operator; and at least one receiver/network interface communicatively coupled with the at least one indicator transmitter and arranged to transmit a first signal responsive to receipt of the notification signal from the at least one indicator transmitter, wherein the at least one indicator transmitter comprises a switch arranged to trigger generation of the notification signal, wherein the switch is automatically activated by a sensor external to the post office box and based on a change of the contents of the post office box.

2. The system as claimed in claim 1, wherein the actuation by an operator occurs responsive to a change of the contents of the post office box.

3. The system as claimed in claim 1, wherein the at least one indicator transmitter and the at least one receiver/network interface are located at an origination location.

4. The system as claimed in claim 1, wherein the at least one indicator transmitter is located adjacent a corresponding at least one post office box.

5. The system as claimed in claim 1, wherein the notification signal comprises information related to the contents of the post office box.

6. The system as claimed in claim 1, wherein the notification signal comprises a post office box identifier.

7. The system as claimed in claim 1, wherein the at least one indicator transmitter and the at least one receiver/network interface are communicatively coupled via a wireless connection.

8. The system as claimed in claim 1, further comprising a notification server communicatively coupled with the at least one receiver/network interface and arranged to transmit a second signal responsive to receipt of the first signal.

9. The system as claimed in claim 1, wherein the receiver/network interface is arranged to transmit the first signal to a client device.

10. The system as claimed in claim 8, wherein the notification server is arranged to transmit the second signal to a client device.

11. The system as claimed in claim 1, wherein the notification signal comprises at least one of a text message, an electronic mail message, a multimedia message, a video message, or an audio message.

12. The system as claimed in claim 1, wherein the first signal comprises at least one of a text message, an electronic mail message, a multimedia message, a video message, or an audio message.

13. The system as claimed in claim 8, wherein the second signal comprises at least one of a text message, an electronic mail message, a multimedia message, a video message, or an audio message.

14. The system as claimed in claim 8, wherein the notification server and the at least one receiver/network interface are physically co-located.

15. The system as claimed in claim 14, wherein a single computer system comprises the notification server and the at least one receiver/network interface.

16. The system as claimed in claim 4, comprising a single indicator transmitter corresponding to each post office box.

* * * * *